United States Patent [19]

Delvecchio et al.

[11] Patent Number: 4,741,271

[45] Date of Patent: May 3, 1988

[54] PROJECTILE FOR ROUND BORE ELECTROMAGNETIC LAUNCHERS WITH SPIN PRODUCED OR PREVENTED BY ELECTROMAGNETIC MEANS

[75] Inventors: Robert M. Delvecchio, Monroeville Boro, Pa.; Emmanuel Aivaliotis, San Jose, Calif.

[73] Assignee: Westinghouse Electric Corp., Pittsburgh, Pa.

[21] Appl. No.: 915,607

[22] Filed: Oct. 6, 1986

[51] Int. Cl.[4] ..... F42B 13/02; F41F 1/02

[52] U.S. Cl. ..... 102/501; 89/8; 124/3; 124/81; 310/12; 318/35

[58] Field of Search ..... 89/8, 6, 6.5; 102/209, 102/439, 501; 124/3, 81; 244/3.23; 310/12, 13, 14; 318/35, 135

[56] References Cited

U.S. PATENT DOCUMENTS

| | | | |
|---|---|---|---|
| 1,985,254 | 12/1934 | Huse | 89/8 |
| 4,449,441 | 5/1984 | McAllister | 89/8 |
| 4,480,523 | 11/1984 | Young et al. | 89/8 |
| 4,555,972 | 12/1985 | Heyne | 89/8 |

*Primary Examiner*—Stephen C. Bentley
*Attorney, Agent, or Firm*—R. P. Lenart

[57] ABSTRACT

A projectile for use in an electromagnetic projectile launcher is provided with a conductive open loop which is mechanically attached to the body of the projectile. Means are provided for electrically connecting the open loop between a pair of generally parallel projectile launching rails when the open loop is in a predetermined angular orientation with respect to the rails. Current flowing in the loop then interacts with magnetic flux produced by current flowing within the rails to place a torque on the loop which can be used to spin-stabilize the projectile or to prevent rotation of the projectile depending upon the particular application.

16 Claims, 5 Drawing Sheets

PROJECTILE FOR ROUND BORE ELECTROMAGNETIC LAUNCHERS WITH SPIN PRODUCED OR PREVENTED BY ELECTROMAGNETIC MEANS

BACKGROUND OF THE INVENTION

This invention relates to projectiles for use in round bore electromagnetic projectile launchers and more particularly to such projectiles which include structures that are used to electromagnetically produce or prevent projectile spin.

Parallel rail electromagnetic projectile launchers include a pair of generally parallel conductive rails, a plasma or sliding conductive armature for conducting current between the rails, a source of high current, and means for commutating this current into the rails and the armature. This flow of current places an electromagnetic force on the armature which propels it along the conductive rails.

Common methods of stabilizing projectiles include the use of stabilizing fins on the projectiles or the use of a rifled barrel assembly. These methods provide spin stabilization which is desirable in many launcher applications. However, there are certain applications, such as where independently guided projectiles are used, wherein projectile spin is to be avoided. Such independently guided projectiles are commonly referred to as "smart" projectiles.

One common electromagnetic launcher construction includes parallel-sided rails which require that at least a portion of the projectile or the associated armature has a rectangular cross section. This essentially precludes imparting rotation to the projectile for spin stabilization. If projectile spin is desired, it must be imparted by separate means such as fins attached to the projectile. Spin stabilization can also be achieved by providing the launcher with skewed conductive rails which cause the projectile to spin by making the armature lock-step with the rails. This introduces additional complexity in the rail design. In addition, slotted coaxial electromagnetic launchers have been proposed which also introduce manufacturing complexities.

Electromagnetic launcher barrels experience forces similar to those of conventional guns. Since such barrels can be made of several sections, these forces make it difficult to successfully introduce rifling for projectile spin stabilization. Where the barrels are segmented, the rifling grooves must not only be consistent in a single section of barrel, but must also be continuous between separate barrel segments. It is therefore desirable to design a projectile which can be spin stabilized without the need for a rifled barrel.

One such spin stabilization method is illustrated in U.S. Pat. No. 4,449,441, issued May 22, 1984 to McAllister. That patent discloses a round bore electromagnetic launcher wherein spin stabilization of a projectile is accomplished through the use of a spin-producing magnetic flux field near the muzzle section of the launcher. To accomplish spin stabilization, the projectile is provided with a cage winding or a magnetic segment having skewed notches, which interact with the spin-producing magnetic flux to impart spin to the projectile.

SUMMARY OF THE INVENTION

The present invention seeks to provide a projectile for use in electromagnetic launchers which is provided with a relatively simple structure that can be configured to induce spin or to prevent spin according to the particular application of a round bore launcher. Projectiles constructed in accordance with this invention include a projectile body and a conductive open loop mechanically attached to the projectile body. Means are provided for electrically connecting the open loop between a pair of generally parallel projectile launching rails when the open loop is in a predetermined angular orientation with respect to the rails. Current flowing in the open loop interacts with the magnetic flux produced by current flowing within the rails to place a torque on the open loop. In the preferred embodiments, the means for electrically connecting the open loop to the rails includes brushes which are electrically connected to the open loop. The configuration and angular placement of these brushes can be controlled so that the loop can be used to impart spin to the projectile or prevent the projectile from spinning.

DESCRIPTION OF THE PREFERRED EMBODIMENTS

Figure 16:
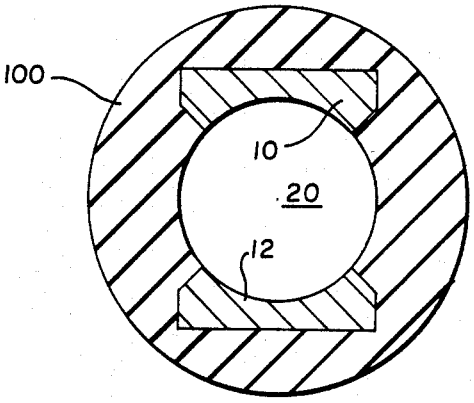
FIG. 16 is a cross-sectional view of the barrel of a round bore electromagnetic projectile launcher in which the projectiles of the present invention may be advantageously used.

Referring to the drawings, FIGS. 1, 2, 3 and 4 are schematic representations of an electromagnetic projectile launcher and an associated open-loop conductor positioned within the bore of the launcher. These drawings show a pair of generally parallel conductive projectile launching rails 10, 12 which are electrically connected to an external power source 14. These rails include arcuate inner surfaces 16, 18 which line a bore 20 lying between these rails and as associated support structure which is illustrated in FIG. 16. A conductive open loop 22 is shown to be positioned within the bore 20. This loop includes a pair of longitudinally extending conductors 24, 26 which are connnected at one end by a transverse conductor 30. Brush members 32, 34 are connected to the other ends of the longitudinally extending conductors 24, 26, respectively. These brush members include arcuate contact surfaces 36, 38 which are shaped to conform to the arcuate internal surfaces 16, 18 of the rails 10, 12. The direction of motion is indicated by arrow 37.

Figure 1:
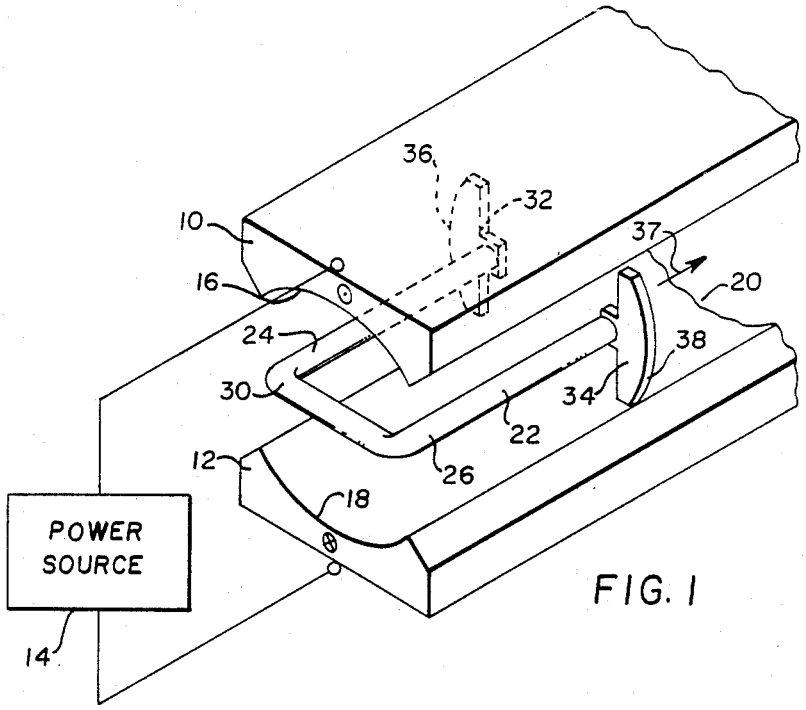
FIGS. 1, 2, 3, 4 are schematic representations of portions of a round bore electromagnetic projectile launcher and an associated open-loop conductor which are used to illustrate the principle of operation of the present invention.
Figure 2:
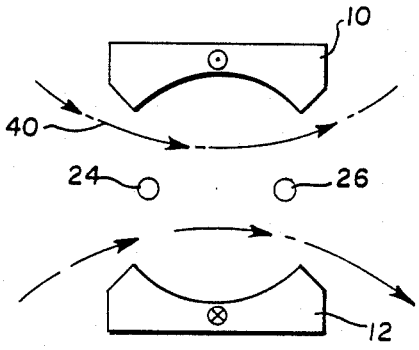

FIG. 2 shows a cross section of the launcher of FIG. 1 with the conductive open loop being oriented such that brush members 32, 34 are not in contact with the conductive rails. The associated projectile armature, not shown, is in front of the open loop 22. Current flow is depicted in the conventional manner with a circled dot indicating current flow out of the sheet and a circled "X" indicating current flow into the sheet. FIG. 2 shows that current flow in the directions indicated results in magnetic flux directed along flux paths 40. Since the open loop of FIG. 1 is constructed so that the brush members are in the same plane as the loop conductors, when the loop is oriented as shown in FIG. 1, no current flows in the loop and there are no forces acting on the conductors which would tend to rotate the loop.

Figure 3:
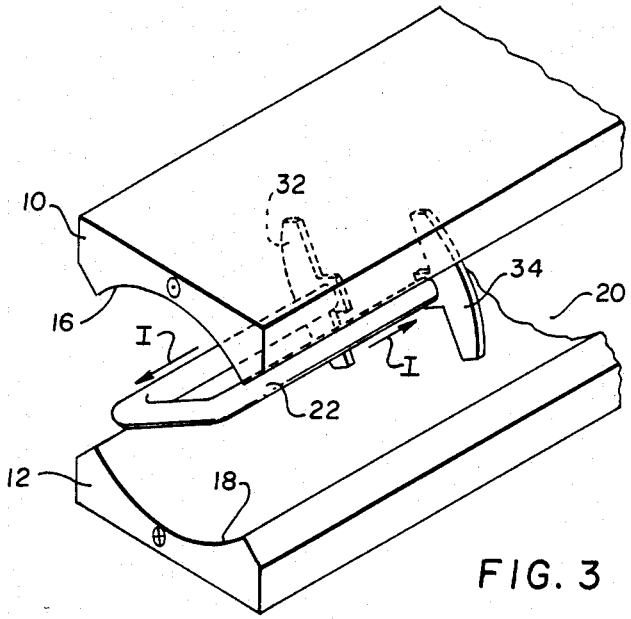
Figure 4:
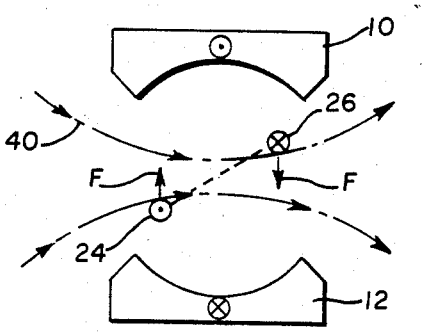

Assume now that for mechanical reasons, the loop has a tendency to rotate, or that it was inserted at a skewed angle; then the brushes are making contact with the rails as illustrated in FIGS. 3 and 4. Under these conditions current I flows in the open loop and the interaction of this current with the magnetic field produced by current flowing within the rails creates a force F on the loop conductors. This force tends to rotate the loop until it reaches the position illustrated in FIGS. 1 and 2. That position can be made very stable if the size of the brush elements is increased so that a minor deviation from the position of FIGS. 1 and 2 immediately causes brush contact with the rails, resulting in current flow in the open loop and a corresponding restoring force.

Figure 5:
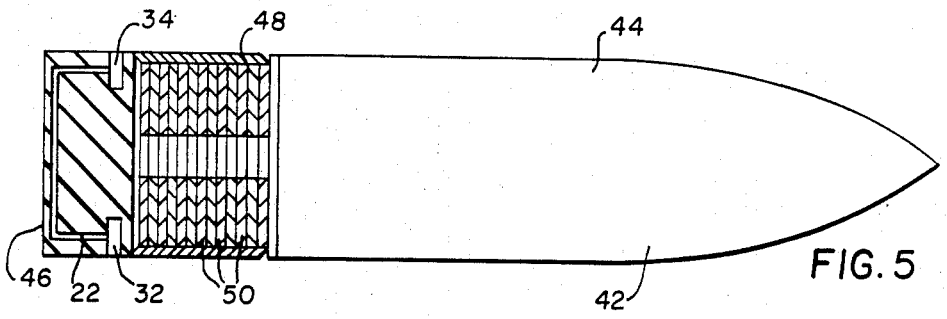
FIGS. 5, 6 are alternative embodiments of a projectile constructed in accordance with this invention which is configured to prevent spin when the projectile is used in a round bore launcher.
Figure 6:
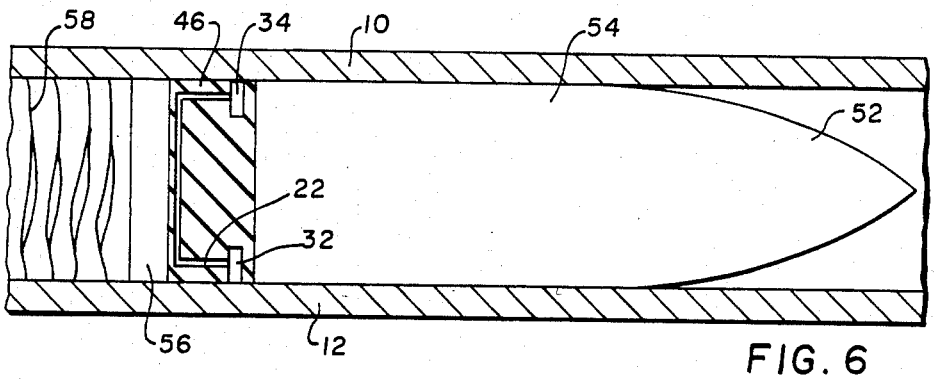

FIGS. 5 and 6 are side views, partially in section, of alternative embodiments of projectiles which include an open-loop structure similar to that illustrated in FIGS. 1–4. In FIG. 5, projectile 42 is shown to include a cylindrical portion 44 which is rigidly connected to an armature and a non-magnetic, non-conductive support structure 46 which encases the open loop 22. The metallic conductive armature 48 which includes a pluarality of conductive disks 50 is shown to be attached to the end of the projectile and serves as means for conducting current between the projectile launching rails. FIG. 6 shows a projectile 52 having a cylindrical portion 54 and a rigidly connected support structure 46. This projectile is configured for a plasma or arc drive and therefore includes an insulating bore-sealing sabot 56 immediately in front of an arc or plasma armature 58. In FIG. 6, the open loop is in front of the plasma for obvious reasons. This configuration relies on the presence of a magnetic field ahead of the armature. For an unaugmented rails system, this field decreases rapidly with distance ahead of the armature. For an augmented rail system, there is a large, rather uniform field ahead of the armature.

Since the open loops of the projectiles of FIGS. 5 and 6 are solidly attached to the projectiles, the projectile behave mechanically in the same way as the loop. Forces which tend to stabilize the rotational position of the loop also stabilize the projectile. The small size of the loop adds minimal inductance to the circuit and current within the loop can be controlled by adjusting the loop resistance. It should therefore be apparent that projectiles which include a stabilizing open loop as illustrated in FIGS. 1–6 will be subject to rotation preventing stabilizing forces if the projectiles rotate enough so that brush members 32, 34 make contact with the projectile launching rails. This design can work equally well with plasma or sliding conductive armatures and is suited for use in launchers where a propelling magnetic field is established by current flowing in the launcher rails.

Figure 7:
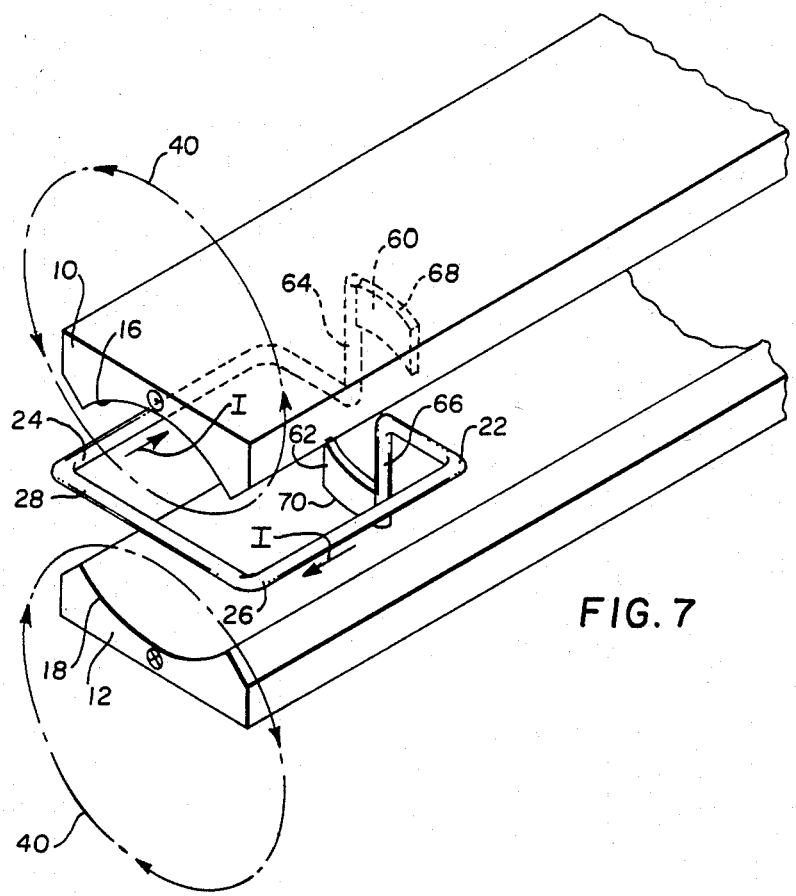
FIG. 7 is a schematic representation of a portion of an electromagnetic launcher and an open-loop conductor configured to produce a spin-imparting torque on the open-loop conductor.

Open-loop conductors can also be utilized in projectiles to produce spin for stabilization. FIG. 7 is a schematic representation of a portion of an electromagnetic projectile launcher having an open loop which is configured to produce a rotational torque on an associated projectile. In this embodiment, brush elements 60, 62 are positioned in a plane perpendicular to the plane of the open loop 22 and connected to the open loop by means of conductor segments 64, 66. Once again, contact surfaces 68, 70 of the brush elements are shaped to conform to the arcuate internal surfaces 16, 18 of the rails 10, 12. If the open loop 22 is oriented as shown between the current-carrying rails 10, 12, the loop conductors experience a force tending to rotate the loop. Note that the loop is fed through brushes from the rails and that the magnetic axis of the open loop is oriented perpendicular to the magnetic field 40 that exists between rails. This is similar to a DC dynamoelectric machine. For smooth operation, this condition should be maintained almost constantly while the projectile is within the launcher bore. This necessitates the use of several open loops and corresponding brush pairs symmetrically placed around the projectile as shown in FIGS. 8–12.

In FIG. 7, the projectile armature, if solid, is assumed to be ahead of the loop. In the case of a plasma armature, or even a solid armature, the loop could be ahead of the armature, especially if augmenting conductors are present.

Figure 8:
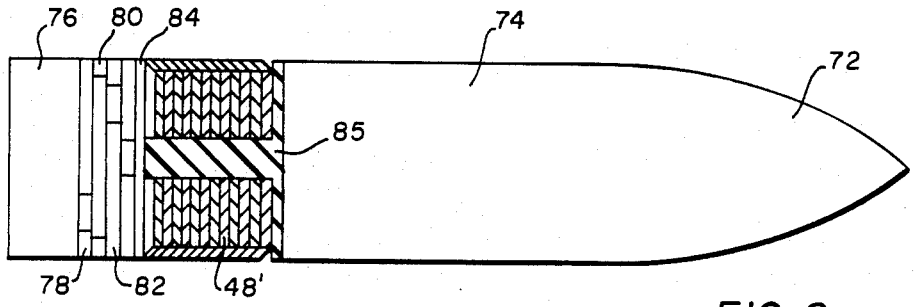
FIG. 8 is a side view of a projectile constructed in accordance with this invention and configured to produce spin.
Figure 9:
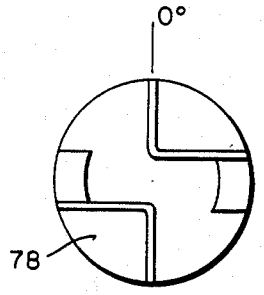
FIGS. 9, 10, 11, 12 are schematic representations of the spin-inducing open loops in the projectile of FIG. 8.
Figure 10:
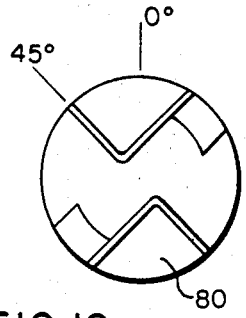
Figure 11:
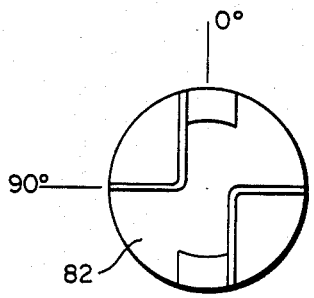
Figure 12:
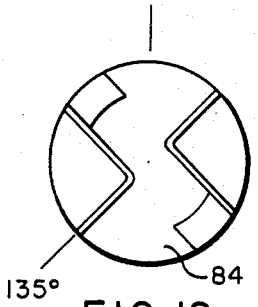
Figure 13:
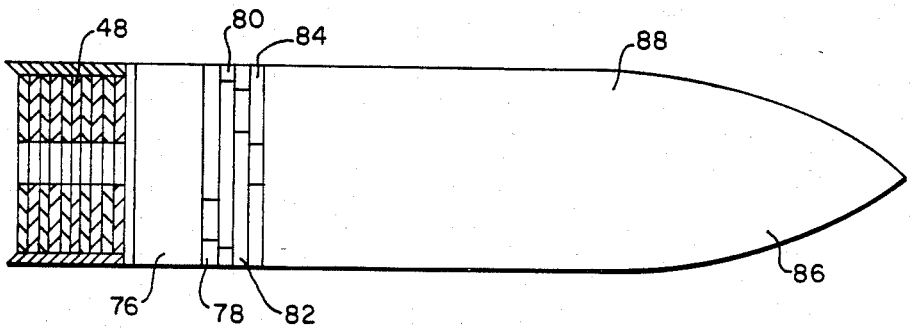
FIG. 13 is a alternative embodiment of a projectile configured for spin stabilization.

FIG. 8 is a side view of a projectile 72 having a generally cylindrical portion 74 and a non-magnetic, non-conductive support structure 76 which houses a plurality of open loops. These open loops are constructed to be shaped similar to the open loop shown in FIG. 7 and are connected to individual brush pairs which are positioned on disks 78, 80, 82, 84. The relative angular position of these open loops and their associated brushes are illustrated in FIGS. 9, 10, 11, 12. While four such loops are shown, the number can vary, depending upon the design. A support member 85 is shown for rigidly connecting the loop assembly to the projectile body. Although a metallic conductive armature 48' is shown in FIG. 8, it should be understood that an arc or plasma armature and as associated insulating sabot can be used as illustrated in FIG. 6 with the loop ahead of the armature. FIG. 13 is a side view of an alternative embodiment of a projectile 86, having a cylindrical portion 88, wherein the spin-producing open-loop structure is mounted in front of the projectile armature 48. The fact that the current-carrying open loops are positioned ahead of the projectile armature does not mean that they do not see a magnetic field, since a rather strong field will exist a short distance ahead of the projectile armature. In augmented projectile launchers, where a field is established throughout the bore by pairs of external augmenting conductors, it is clear that a field will always exist at the location of the open loops (ahead of the armature) due to the currents in the augmenting conductors.

Figure 15:
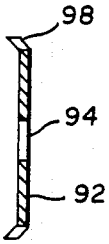
FIGS. 14, 15 are plan and side views of an armature lamination which may be used with the projectiles of FIG. 8.
Figure 14:
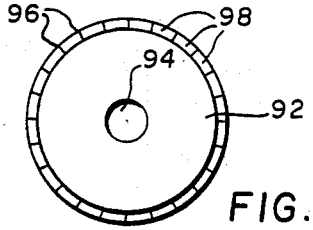

FIGS. 14 and 15 show plan and side views of one of the disks 92 used to construct the armature 48' in FIG. 8. Note that each disk has a central aperture 94 for receiving the support member 85. A plurality of slits 96 are provided near the periphery of the disk so that tabs 98 can be bent with respect to the plane of the disk. FIG. 16 is a cross-sectional view of a round bore electromagnetic projectile launcher which is suitable for launching the projectiles of the present invention. Note that an insulating support structure 100 holds the projectile launching rails 10, 12 in place and also serves to form a portion of the cylindrical bore which lies between the launching rails.

It should be noted that in view of the magnitudes of currents and magnetic fields generated in the vicinity of the projectile, the stabilizing or rotation-producing loops of the present invention need not be large or carry large currents to accomplish their function. Being small in size, they introduce minimal inductance in the circuit and thus current through them can be easily controlled by varying resistance. For a given electromagnetic launcher system, the torque and rotational speed of a spin-stabilized projectile can be controlled through appropriate open-loop resistance adjustment with the possibility of varying interconnections and brush orientations to provide further control.

Although the present invention has been described in terms of what are at present believed to be its preferred embodiments, it will be apparent to those skilled in the art that various changes may be made without departing from the scope of the invention. It is therefore intended that the appended claims cover such changes.

We claim:

1. A projectile for use with an electromagnetic projectile launcher, said projectile comprising:

a projectile body;

a conductive open loop mechanically attached to said projectile body; and means for electrically connnecting said open loop between a pair of generally parallel projectile launching rails when said open loop is in a predetermined angular orientation with respect to said rails, whereby current flowing in said open loop interacts with magnetic flux produced by current flowing within said rails to place a torque on said open loop.

2. A projectile as recited in claim 1, wherein said means for electrically connecting the open loop between the rails comprises:

a first brush electrically connected to a first end of said loop; and a second brush electrically connected to a second end of said loop;

each of said brushes including a contact surface shaped to conform to an internal surface of each of said rails.

3. A projectile as recited in claim 2, wherein said brushes and said open loop generally lie in the same plane.

4. A projectile as recited in claim 2, wherein said brushes and said open loop generally lie in substantially perpendicular planes.

5. A projectile as recited in claim 2, wherein the length of said contact surfaces is less than the length of an arcuate internal surface of an insulating structure lining a portion of a bore between said rails.

6. A projectile as recited in claim 1, further comprising:

a conductive armature for conducting current between said rails, said armature being positioned behind said open loop.

7. A projectile as recited in claim 1, further comprising:

a conductive armature for conducting current between said rails, said armature being positioned in front of said open loop.

8. A projectile as recited in claim 1, further comprising:

a non-magnetic, non-conductive support structure encasing said open loop.

9. A projectile as recited in claim 1, further comprising:

an insulating, bore-sealing sabot positioned behind said open loop.

10. A projectile for use with an electromagnetic projectile launcher, said projectile comprising:

a projectile body;

a plurality of conductive open loops mechanically attached to said projectile body; and means for electrically connecting each of said open loops between a pair of generally parallel projectile launching rails when said projectile body is in one of a plurality of predetermined angular positions with respect to said rails, whereby current flowing in at least one of said open loops interacts with magnetic flux produced by current flowing within said rails to place a torque on said projectile body.

11. A projectile as recited in claim 10, wherein said means for electrically connecting said open loops between said rails comprises:

a plurality of pairs of brushes, one brush of each pair being connected to a first end of each open loop and a second brush of each pair being connected to a second end of each open loop;

each of said brushes including a contact surface shaped to conform to an internal surface of each of said rails.

12. A projectile as recited in claim 11, wherein each pair of said brushes and the connected one of said loops lie in substantially perpendicular planes.

13. A projectile as recited in claim 10, further comprising:

a conductive armature for conducting current between said rails, said armature being positioned behind said open loops.

14. A projectile as recited in claim 10, further comprising:

a conductive armature for conducting current between said rails, said armature being positioned in front of said open loops.

15. A projectile as recited in claim 10, further comprising:

a non-magnetic, non-conductive support structure encasing said open loops.

16. A projectile as recited in claim 10, further comprising:

an insulating, bore-sealing sabot positioned behind said open loops.

* * * * *